US006264532B1

(12) United States Patent
Meloni

(10) Patent No.: US 6,264,532 B1
(45) Date of Patent: Jul. 24, 2001

(54) ULTRASONIC METHODS AND APPARATUS FOR THE IN-SITU DETECTION OF WORKPIECE LOSS

(75) Inventor: Mark A. Meloni, Tempe, AZ (US)

(73) Assignee: SpeedFam-IPEC Corporation, Chandler, AZ (US)

( * ) Notice: Subject to any disclaimer, the term of this patent is extended or adjusted under 35 U.S.C. 154(b) by 0 days.

(21) Appl. No.: 09/536,580

(22) Filed: Mar. 28, 2000

(51) Int. Cl.[7] ..... B24B 49/00; B24B 51/00
(52) U.S. Cl. ..... 451/6; 451/21; 451/444
(58) Field of Search ..... 451/5, 6, 8, 9, 451/10, 21, 28, 41, 56, 54, 287, 288, 443, 444, 165

(56) References Cited

U.S. PATENT DOCUMENTS 4,272,924 6/1981 Masuko et al. .
5,245,790 * 9/1993 Jerbic ..... 51/121
5,688,364 * 11/1997 Sato ..... 156/636.1
5,791,973 8/1998 Nishio .
5,964,653 10/1999 Perlov et al. .
6,045,434 * 4/2000 Fisher, Jr. et al. ..... 451/21

FOREIGN PATENT DOCUMENTS 0 878 691 5/1998 (EP) .

* cited by examiner

*Primary Examiner*—Derris H. Banks
(74) *Attorney, Agent, or Firm*—Snell & Wilmer L.L.P.

(57) ABSTRACT

An apparatus for use with a chemical mechanical planarization (CMP) system includes an ultrasonic source that is disposed proximate a workpiece carrier. The ultrasonic source generates an ultrasonic signal toward an area of a polishing pad or a workpiece during the polishing of the workpiece held by the carrier. An ultrasonic detector is configured to receive a reflected ultrasonic signal for processing in order to determine the presence of extraneous material at the area of the polishing pad.

11 Claims, 6 Drawing Sheets

ULTRASONIC METHODS AND APPARATUS FOR THE IN-SITU DETECTION OF WORKPIECE LOSS

BACKGROUND

1. Field of the Invention

The present invention generally relates to methods and apparatus for the in-situ detection of the loss or breakage of a workpiece during the chemical mechanical polishing (CMP) of the workpiece, and more particularly, to methods and apparatus for directing an ultrasonic signal onto the surface of a polishing pad or workpiece during polishing of the workpiece, and analyzing the reflection of the ultrasonic signal to detect real-time workpiece loss or breakage.

2. Description of the Related Art

The production of semiconductor devices begins with the creation of high quality semiconductor wafers. Because of the high precision required in the production of these semiconductor devices, an extremely flat surface is generally needed on at least one side of the semiconductor wafer to ensure proper accuracy and performance of the microelectronic structures being created on the wafer surface. CMP is often used to remove material from the surface of the wafer or workpiece to provide a relatively flat surface.

Such polishing is well known in the art and generally includes placing one side of the workpiece in contact against a flat polishing surface, and moving the workpiece and the polishing surface relative to each other. A slury, including abrasive particles and/or chemicals that react with the material on the workpiece surface to dissolve the material, may also be placed in contact with the workpiece surface to assist removing a portion of the material. During the polishing or planarization process, the workpiece is typically held by a workpiece carrier and pressed against the polishing pad while the pad rotates. In addition, to improve the polishing effectiveness, the workpiece may also rotate and oscillate back and forth over the surface of the polishing pad.

During the CMP process, workpieces occasionally become dislodged from the workpiece carrier, or they may break during polishing. If a dislodged workpiece, a part of a broken workpiece, or other extraneous material is allowed to remain on the polishing table, it could contact other workpieces and/or workpiece carriers on the same polishing table and thereby damage or destroy all of the workpieces on the table. Accordingly, it is desirable to detect the presence of a broken or dislodged workpiece immediately and to terminate processing until the situation can be rectified. Typically, this requires a thorough cleaning and/or replacement of the polishing pad, so that workpiece fragments and other debris can be removed so that they do not damage other intact workpieces.

Presently known optical systems for detecting the loss of workpieces or for detecting broken workpieces are unsatisfactory in several regards. For example, currently known systems may be limited to operation with a small number of similarly colored polishing pads. Such known systems may be ineffective for detecting workpiece loss on a dark colored polishing pad or in an environment where the polishing pad may become discolored over time. Present optical systems may also be inadequate in CMP environments that employ a large amount of polishing slurry and/or polishing slurry having a variety of colors due to the effect of light scattering or transmission loss of the light signal. Furthermore, the presence of slurry, deionized water, and such staining CMP slurry compounds as potassium iodide and the like on the pad, and on the workpiece itself, tend to mask the reflected light signal, preventing the signal from being properly detected by the photo detector. Consequently, many presently known workpiece detection schemes often emit "false" readings whereupon machines are shut down and processing halted even though all workpieces remain intact within their respective carriers.

Therefore, a technique for detecting lost or dislodged workpieces on a CMP polishing pad is thus needed which overcomes the shortcomings of the prior art.

SUMMARY OF THE INVENTION

The present invention provides an improved method and apparatus for detecting the real-time breakage or loss of a workpiece during the planarization process. More particularly, the present invention provides a device to detect the breakage or loss of a workpiece by generating an ultrasonic signal and directing the ultrasonic signal at an area on the surface of a polishing pad or workpiece, and analyzing the reflection of the ultrasonic signal to obtain real-time detection of the loss or breakage of a workpiece.

In accordance with an exemplary embodiment of the present invention, an ultrasonic sensor assembly is mounted to a CMP machine. The ultrasonic assembly comprises an ultrasonic source and an ultrasonic detector. The ultrasonic source is configured to generate and direct an incident ultrasonic signal at an area on the surface of the polishing pad or workpiece as the workpiece is being polished. The incident ultrasonic signal is absorbed, scattered, and reflected to produce a reflected beam. The ultrasonic detector is configured to receive the reflected beam, and the reflected beam is then processed by a processor to detect the breakage or loss of the of the workpiece.

BRIEF DESCRIPTION OF THE DRAWINGS

A more complete understanding of the present invention may be derived by referring to the detailed description and claims when considered in connection with the following illustrative Figures, which may not be to scale. In the following Figures, like reference numbers refer to similar elements throughout the Figures.

DETAILED DESCRIPTION

The present invention relates to a method and apparatus used in conjunction with a chemical mechanical polishing (CMP) machine, for the in-situ detection of a dislodged or fractured workpiece on a polishing pad or within a wafer carrier using an ultrasonic source and detector. Although the present invention may be used in conjunction with the polishing of a variety of workpieces such as magnetic disks, optical disks and the like, the present invention is conveniently described below in connection with polishing semiconductor wafers.

Figure 1:
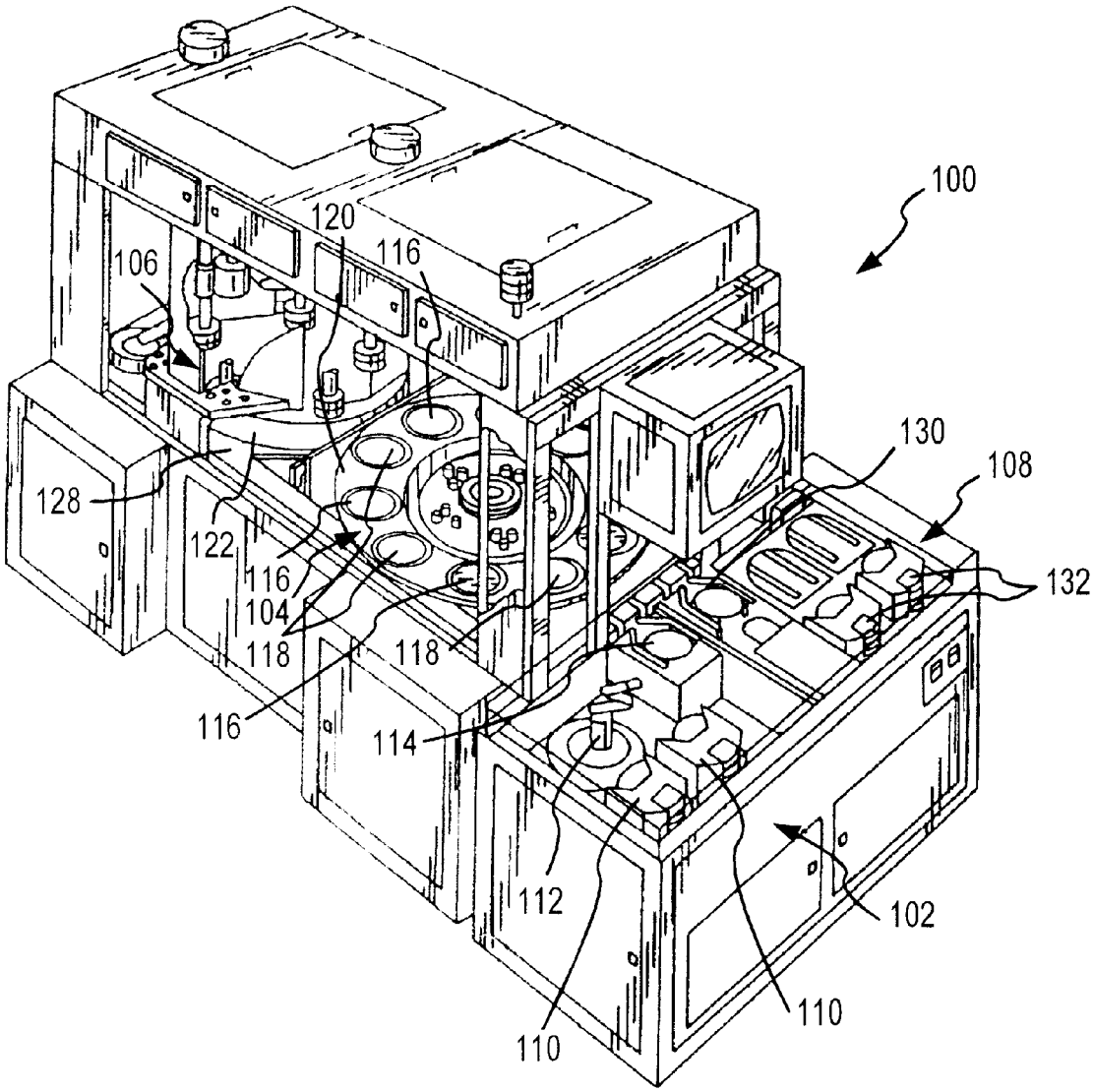
(PRIOR ART) FIG.1
FIG. 1 illustrates, in perspective view, an exemplary CMP machine useful in the context of the present invention.
Figure 2:
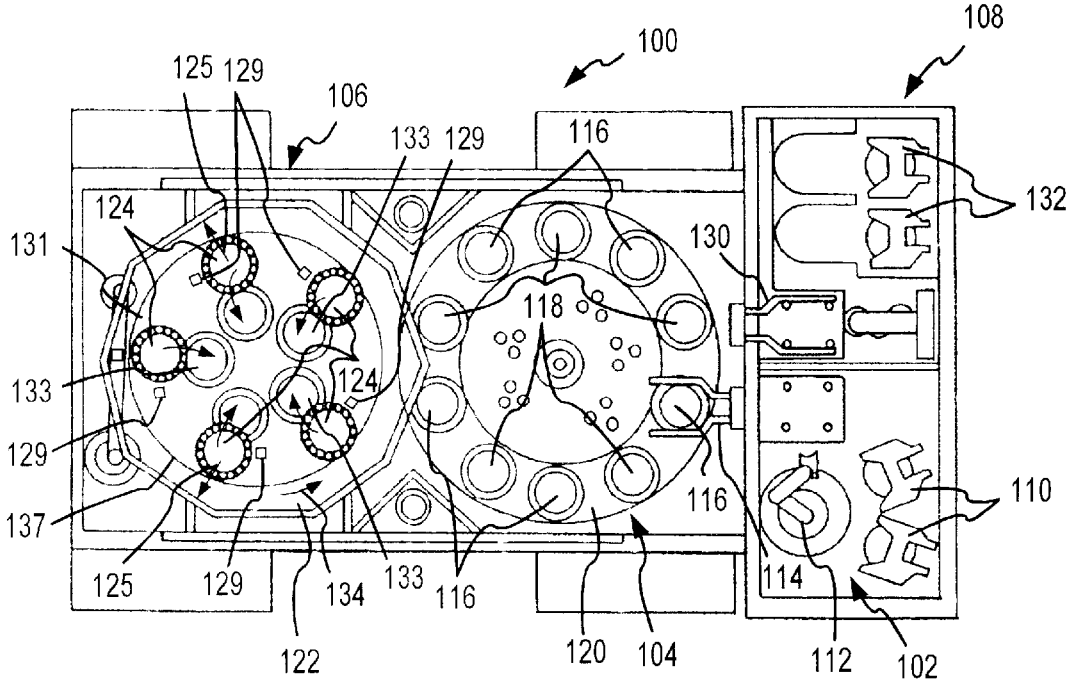
FIG. 2 illustrates, in top view, the CMP machine of FIG. 1, showing an exemplary orientation of an ultrasonic sensor assembly in accordance with the present invention.

Referring now to FIGS. 1 and 2, a CMP machine 100 is illustrated in accordance with an exemplary embodiment of the present invention. CMP machine 100 suitably comprises a multiple head wafer polishing machine which accepts wafers from wafer cassettes 110, polishes and rinses the wafers, and reloads the wafers back into wafer cassettes 110 for subsequent processing. CMP machine 100 suitably includes an unload station 102, a wafer transition station 104, a polishing station 106, and a wafer rinse and load station 108.

In operation, cassettes 110, each holding a plurality of wafers, are loaded into CMP machine 100 at unload station 102. Next, a robotic wafer carrier arm 112 removes the wafers from cassettes 110 and places them, one at a time, on a first wafer transfer arm 114. Wafer transfer arm 114 then sequentially lifts and moves each wafer into wafer transition station 104. That is, transfer arm 114 suitably places an individual wafer on one of a plurality of wafer pick-up stations 116 which reside on a rotatable table 120 within wafer transition station 104. Rotatable table 120 also suitably includes a plurality of wafer dropoff stations 118 which alternate with pick-up stations 116. After a wafer is deposited on one of the plurality of pick-up stations 116, table 120 rotates so that a new station 116 aligns with transfer arm 114. Transfer arm 114 then places the next wafer on the new empty pick-up station 116. This process continues until all pick-up stations 116 are filled with wafers. In the illustrated embodiment of the invention, table 120 includes five pick-up stations 116 and five drop-off stations 118.

Next, a wafer carrier apparatus 122, comprising individual wafer carrier elements 124, suitably aligns itself over table 120 so that respective carrier elements 124 are positioned directly above the wafers which reside in respective pick-up stations 116. The carrier apparatus 122 then drops down and picks up the wafers from their respective stations and moves the wafers laterally such that the wafers are positioned above polishing station 106. Once above polishing station 106, carrier apparatus 122 suitably lowers the wafers, which are held by individual elements 124, into operative engagement with a polishing pad 131 which sits atop a platen 137. During operation, platen 137 causes polishing pad 131 to rotate about its vertical axis (substantially along arrow 134). At the same time, individual carrier elements 124 spin the wafers about their respective vertical axes and oscillate the wafers back and forth across pad 131 (substantially along arrow 133) as the wafers press against polishing pad 131. In this manner, material is removed from a surface of the wafer by polishing or planarization. Such polishing often occurs in the presence of a slurry composition deposited between the wafer and the polishing pad.

After an appropriate period of time, the wafers are removed from polishing pad 131, and carrier apparatus 122 transfers the wafers back to transition station 104. Carrier apparatus 122 then lowers individual carrier elements 124 and deposits the wafers onto drop-off stations 118. The wafers are then removed from drop-off stations 118 by a second transfer arm 130. Transfer arm 130 suitably lifts each wafer out of transition station 104 and transfers them into wafer rinse and load station 108. In the load station 108, transfer arm 130 holds the wafers while they are rinsed. After a thorough rinsing, the wafers are reloaded into cassettes 132 for further processing or packaging.

Figure 3:
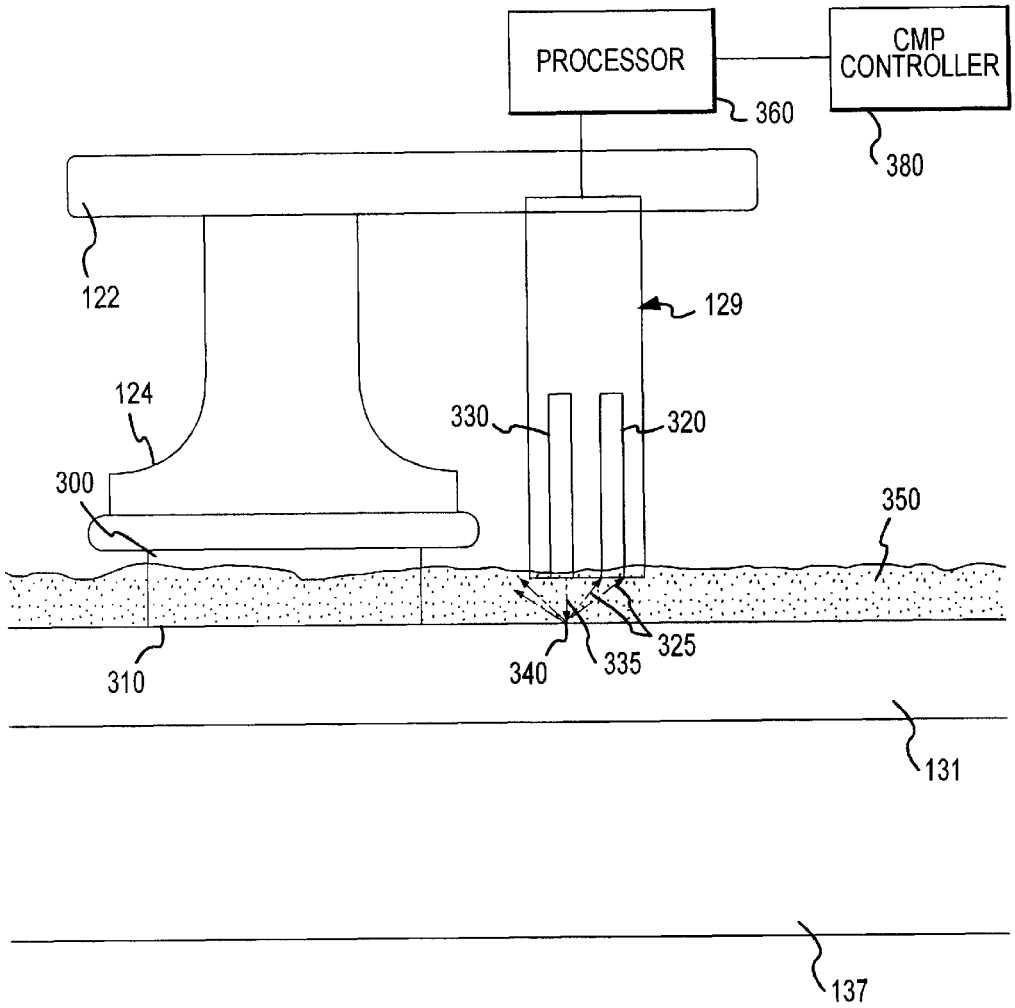
FIG. 3 illustrates, in schematic view, the configuration of the probe assembly with an area of the polishing pad in the field of view of the probe, and further including various processing components for detecting the loss of a workpiece.

Referring now to FIG. 3, a schematic representation of an exemplary ultrasonic assembly 129 in accordance with the present invention is illustrated in operation within a typical CMP environment. Although the CMP environment preferably includes a plurality of ultrasonic assemblies 129 for use with a number of carrier elements 124, only a single ultrasonic assembly 129 is illustrated in FIG. 3 for clarity. As shown in FIG. 2, ultrasonic sensor assembly 129 is suitably positioned proximate each carrier element 124 downstream of platen rotation (direction 134). Ultrasonic assembly 129 suitably includes an ultrasonic source 330 and an ultrasonic detector 320. Ultrasonic assembly 129 may be a conventional ultrasonic gauge such as the Model 25DL or Model 25DL-RR from Panametrics Inc. of Waltham, Mass. or the Model TM1-CDL or Model TM1-D from Radiatronics NDT, Inc. of Shawnee Mission, Kans.

Ultrasonic source 330 is configured to direct a source ultrasonic signal 335 (depicted in phantom lines) at an area 340 on the surface of polishing pad 131 as the wafer is being polished. Ultrasonic assembly 129 may operate at a frequency in the range of 500 KHz to 100MHz, with a preferred range of 1 MHz to 5 MHz. As described above, polishing station 106 is suitably configured to remove material from a lower surface 310 of wafer 300. Wafer 300 is pressed against and rotated relative to polishing pad 131 of platen 137 while at least a portion of surface 310 is in contact with at least a portion of polishing pad 131. Polishing slurry 350 is preferably employed to assist in the polishing of wafer 300. Ultrasonic assembly 129 may be mounted to wafer carrier apparatus 122 and positioned to point at polishing pad 131 at a 90 degree angle perpendicular) or at a non-90 degree angle. Ultrasonic assembly 129 is preferably in contact with aqueous polishing slurry 350 as the transmission of ultrasonic signals in air is poor. However, it will be appreciated that ultrasonic assembly 129 does not have to be in contact with polishing slurry 350.

Figure 4:
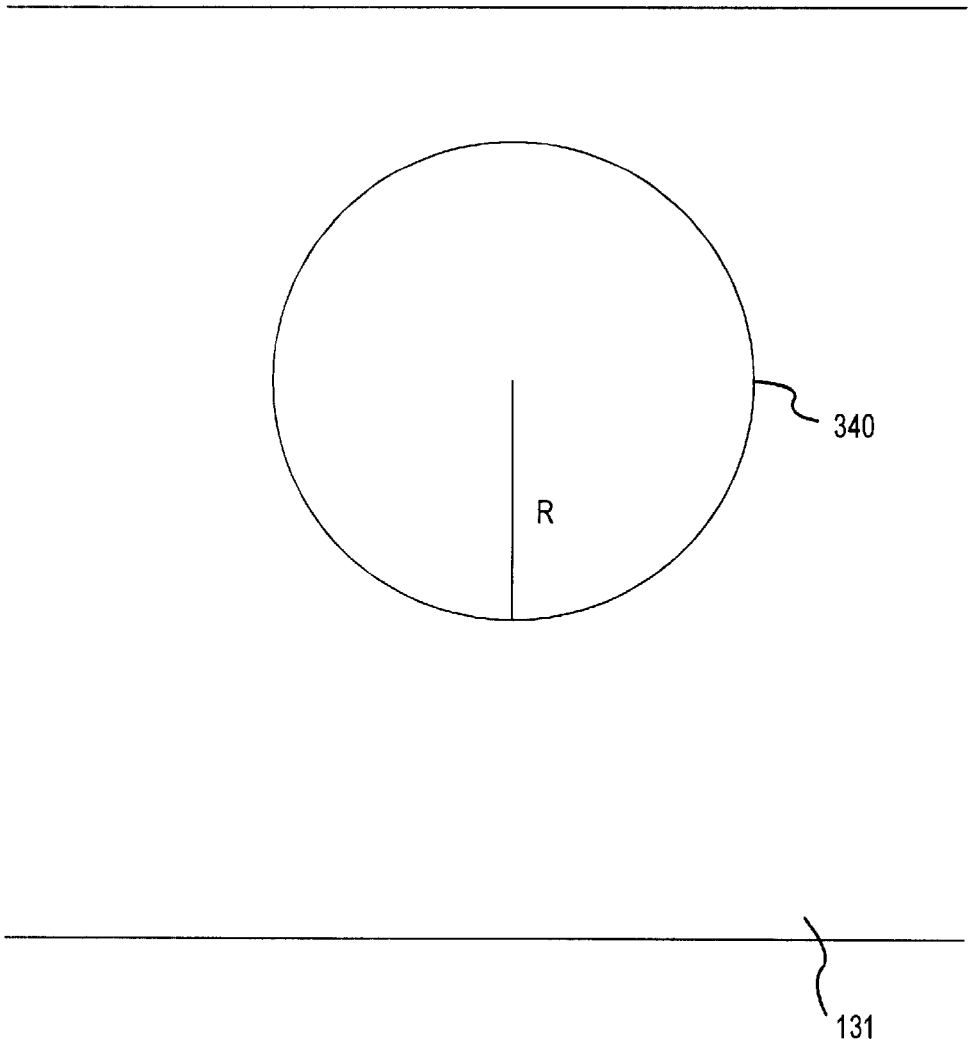
FIG. 4 illustrates, in top view, a circular area of coverage provided by the probe assembly of FIG.3.
Figure 5:
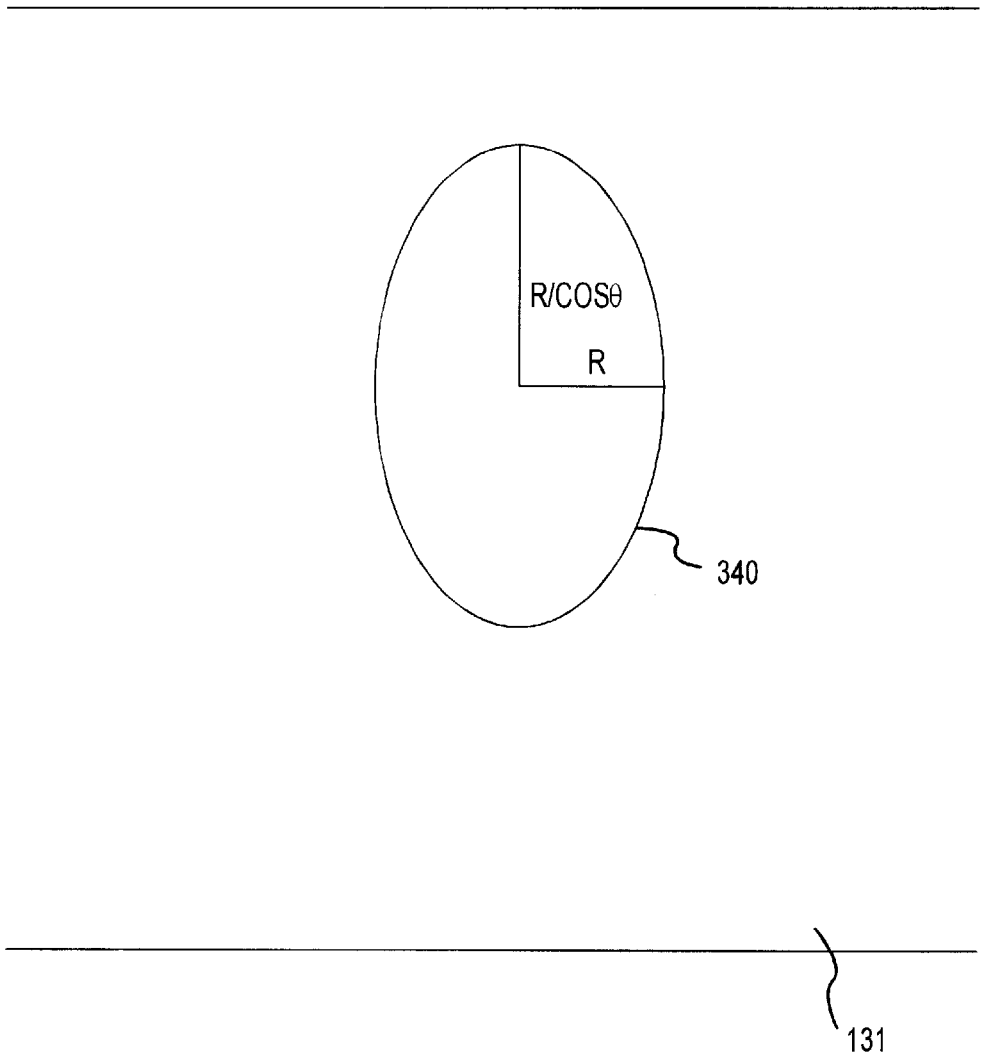
FIG. 5 illustrates, in top view, an elliptical area or coverage provided by the probe assembly of FIG. 3.

Referring momentarily to FIG. 4, when the ultrasonic assembly is mounted in a perpendicular orientation relative to polishing pad 131, a circular area of coverage is provided for, such as circular area 340. The ultrasonic assembly is easier to mount when in a perpendicular orientation as compared to the non-90 degree orientation. Referring momentarily to FIG. 5, when ultrasonic assembly 129 is mounted in a non-90 degree angle orientation relative to polishing pad 131, an elliptical area of coverage is provided for, such as elliptical area 340. The size of the elliptical area is determined by the angle of the ultrasonic assembly relative to the polishing pad and the distance from the ultrasonic assembly to the polishing pad. The non-90 orientation may provide for a larger area of coverage with the same or small sized ultrasonic assembly then the perpendicular orientation, as the ultrasonic assembly may be angled to provide a larger area of coverage.

Ultrasonic detector 320 is positioned to receive a reflected ultrasonic signal 325 that results from source ultrasonic signal 335 being absorbed into polishing slurry 350 and polishing pad 131 and then being reflected away from the polishing pad. The amplitude of reflected ultrasonic signal 325 is dependent upon the density of the polishing slurry and polishing pad 131. Reflected ultrasonic signal 325 may be transmitted to a processor 360 that is connected to ultrasonic assembly 129. Thus, the amplitude of reflected ultrasonic signal 325 may be processed by processor 360, in order to determine the presence of a piece of wafer 300 or the presence of the whole wafer at area 340 where the ultrasonic signal was absorbed and reflected from the surface of polishing pad 131. Processor 360 is preferably coupled to a display device or a printer so that human readable output of the presence of wafer 300 is displayed.

In accordance with an exemplary embodiment of the present invention, ultrasonic sensor assembly 129 uses commonly known ultrasonic technology in order to gather data for the real-time detection of breakage or loss of wafer 300. There are at least two primary techniques for detecting the breakage or loss of a wafer using ultrasonic signals. One technique utilizes the intensity or amplitude of the reflected ultrasonic signal and the other technique utilizes the echo timing of the response or reflected ultrasonic signal. These techniques will be described next.

As is well known in the art, the amplitude of reflected ultrasonic signal 325 is dependent on the density of the material from which the signal is reflected. In general, the polishing pad 131 will reflect less signal (i.e., lower amplitude signal) then the wafer. Therefore, is a wafer becomes dislodged or fragmented, then the amplitude of the reflected ultrasonic signal will increase when the wafer or wafer fragment crosses into area of coverage 340. An amplitude range can be predetermined as described below for the range of amplitudes that would indicate the presence of a wafer or wafer fragment. Thus, the presence of extraneous material within area 340 can be detected when the amplitude of reflected ultrasonic signal 325 is measured within the predetermined range.

The echo timing of the reflected ultrasonic signal can also be utilized to detect wafer loss or breakage. The echo timing of the reflected ultrasonic signal refers to the round trip time from the transmission of the source ultrasonic signal to the reception of the reflected ultrasonic signal. A normal echo time can be predetermined by the round trip time of the ultrasonic signal from the ultrasonic source to the polishing pad and back to the ultrasonic detector. If a wafer or a wafer fragment intercepts the ultrasonic signal, then the round trip time is decreased due to the smaller distance between the reflecting surface of the wafer or wafer fragment and the ultrasonic assembly. Thus, if the round trip time of the ultrasonic signal decreases to a predetermined range, then this may also indicate wafer loss or breakage.

In accordance with the illustrated embodiment depicted in FIG. 2, ultrasonic assembly 129 is suitably mounted above and adjacent to each carrier element 124 so that a field of view 340 of each ultrasonic assembly 129 is directly in front of the respective carrier element 124. That is, if polishing pad 131 is rotating counter-clockwise, as shown by arrow 134 (see FIG. 2), ultrasonic assembly 129 is positioned such that a wafer (or wafer fragment) will enter field of view 340 as soon as possible and will stop the machine before other wafers can be damaged by the broken/dislodged workpiece or other debris. Similarly, if polishing pad 131 is rotating clockwise, ultrasonic assembly 129 will be configured so that field of view 340 is directed to the opposite side of each carrier element 124. It will be appreciated, however, that many other orientations of the ultrasonic assembly may be possible.

Figure 6:
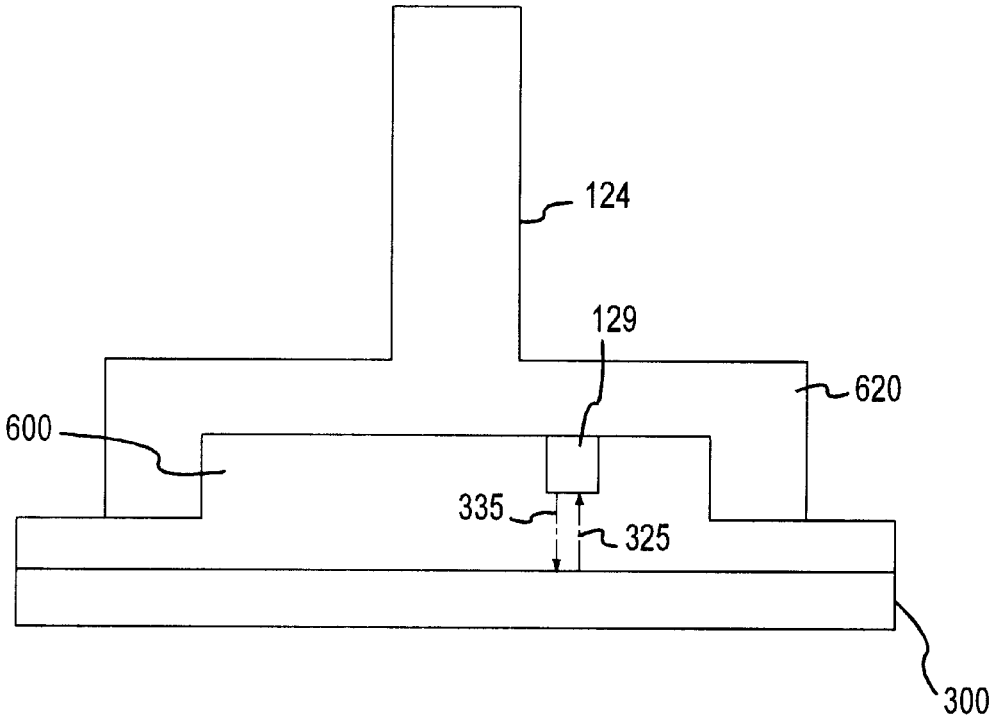
FIG. 6 illustrates, in cross section, the configuration of the probe assembly mounted within a wafer carrier.

Alternatively, ultrasonic assembly 129 may be mounted in carrier element 124 behind wafer 300. Referring to FIG. 6, carrier element 124 comprises a chamber housing 620 and a chamber 600. Ultrasonic assembly 129 is mounted to chamber housing 620 such that the assembly is oriented to produce an ultrasonic signal at wafer 300. Ultrasonic assembly 129 may be powered by battery or by external service (not shown). Chamber 600 of carrier element 124 may be filled with a liquid, gas, or the like to facilitate the transmission of ultrasonic signals. The same techniques described above can be used to detect wafer loss or breakage for this orientation. Reflected ultrasonic signal 325 may be transmitted to processor 360 by radio frequency (RF) or electrical means or the like as is known in the art.

As described above, processor 360 indicates the presence of extraneous material proximate the area within field of view 340 when the amplitude or echo timing of reflected ultrasonic signal 325 is measured within the predetermined range. Consequently, ultrasonic assembly 129 refrains from indicating the presence of extraneous material proximate field of view 340 when the amplitude or echo timing is not measured within the predetermined range. The amplitude range or echo timing indicative of the presence of extraneous material is preferably established by performing empirical reflectivity tests for workpieces (e.g., semiconductor wafers) under a variety of operating conditions and environments. The amplitude range or echo timing may also be selected according to the operating specifications of ultrasonic assembly 129 or other components of CMP machine 100. It should be appreciated that the predetermined range is substantially independent of physical characteristics of polishing pad 131, for example, the color, optical reflectivity, or the like. Furthermore, because the amplitude range is associated with the density of the wafer, the amplitude range may also be configured to be substantially independent of physical characteristics of the polishing slurry used during the CMP procedure.

According to a desired aspect of the present invention, if a wafer or wafer fragment is detected, processor 360 sends a signal to a CMP controller 380 which, in turn, immediately shuts down CMP machine 100. Processor 360 may alternatively, or additionally, trigger warning devices or control various other components of CMP machine 100. In the preferred embodiment, ultrasonic source 330 and ultrasonic detector 320 operate in a substantially continuous manner and processor 360 samples reflected ultrasonic signal 325 at a suitable sampling rate such as 1000 samples/second.

The present invention has been described above with reference to a preferred embodiment. However, those skilled in the art having read this disclosure will recognize that changes and modifications may be made to the preferred embodiment without departing from the scope of the present invention. These and other changes or modifications are intended to be included within the scope of the present invention, as expressed in the following claims.

What is claimed is:

1. An apparatus for detecting the presence of an extraneous material on a polishing pad of a chemical mechanical polishing machine during polishing of a workpiece held by a carrier against a surface of the polishing pad, the apparatus comprising:

an ultrasonic source proximate the carrier, the ultrasonic source configured to direct an input ultrasonic signal at an area on the surface of the polishing pad, wherefrom the input ultrasonic signal is reflected to created a reflected signal; and an ultrasonic detector proximate the carrier, the ultrasonic detector configured to receive the reflected signal, wherein the reflected signal is processed to generate an output indicative of the presence or absence of the extraneous material at the area on the polishing pad.

2. The apparatus of claim 1, wherein the extraneous material is the workpiece or a piece of the workpiece.

3. The apparatus of claim 1, wherein the workpiece comprises a semiconductor wafer.

4. The apparatus of claim 1, wherein the area comprises a circular area.

5. The apparatus of claim 1, wherein the area comprises an elliptical area.

6. A chemical mechanical polishing apparatus configured to detect the loss of a workpiece while polishing the workpiece, wherein the workpiece has an upper surface and a lower surface, the apparatus comprising:

a rotatable workpiece carrier configured to carry the workpiece;

a rotatable polishing pad, the polishing pad disposed opposite the workpiece carrier, wherein the lower surface of the workpiece is pressed against the polishing pad during polishing of the workpiece; and an ultrasonic sensor assembly attached to a portion of the workpiece carrier, the assembly configured to direct an input ultrasonic signal toward a location on the upper surface of the workpiece to detect the presence or absence of the workpiece at the location, wherefrom the input ultrasonic signal is reflected to create a reflected signal, the assembly comprising:

an ultrasonic source configured to produce the input ultrasonic signal; and an ultrasonic detector configured to receive the reflected signal.

7. The apparatus of claim 6, wherein the workpiece comprises a semiconductor wafer.

8. A method for detecting the loss of a workpiece while polishing the workpiece, comprising the steps of:

carrying a workpiece in a workpiece carrier;

pressing the workpiece against a surface of a rotating polishing pad mounted on a platen such that the workpiece is polished by the rotating polishing pad;

disposing an ultrasonic sensor assembly proximate the carrier;

directing an ultrasonic signal at an area on the surface of the polishing pad proximate the carrier, wherefrom the ultrasonic signal is reflected to produce a reflected signal;

receiving the reflected signal from the surface of the polishing pad; and processing the reflected signal to determine the loss of a workpiece.

9. The method according to claim 8, wherein the processing step indicates when the workpiece is dislodged from the carrier.

10. The method according to claim 8, wherein the processing step indicates when a piece of the workpiece is dislodged from the carrier.

11. The method according to claim 8, wherein the directing step directs the ultrasonic signal at an angle between 90 degrees and 20 degrees relative to the surface of the polishing pad.

* * * * *